US007654707B2

(12) United States Patent
Russello et al.

(10) Patent No.: US 7,654,707 B2
(45) Date of Patent: Feb. 2, 2010

(54) REAR TRIM RING FOR A VANDAL RESISTANT LUMINAIRE

(75) Inventors: Thomas Russello, Freehold, NJ (US); Dylan A. Akinrele, Leonia, NJ (US); David S. Monteiro, Belleville, NJ (US); Kenneth W. Biello, Stroudsbourg, PA (US)

(73) Assignee: QUALCOMM Incorporated, San Diego, CA (US)

( * ) Notice: Subject to any disclaimer, the term of this patent is extended or adjusted under 35 U.S.C. 154(b) by 201 days.

(21) Appl. No.: 11/741,306

(22) Filed: Apr. 27, 2007

(65) Prior Publication Data

US 2007/0253192 A1 Nov. 1, 2007

Related U.S. Application Data

(60) Provisional application No. 60/745,913, filed on Apr. 28, 2006.

(51) Int. Cl.
*F21V 15/04* (2006.01)

(52) U.S. Cl. ..... 362/369; 362/368; 362/390

(58) Field of Classification Search ..... 362/145, 362/147, 267, 368, 369, 374, 375, 390, 404, 362/457; 220/200, 226, 231
See application file for complete search history.

(56) References Cited

U.S. PATENT DOCUMENTS 1,388,221 A 8/1921 Toepfer
1,539,131 A 5/1925 McCarley
1,633,837 A 6/1927 Youtz
2,166,394 A 7/1939 Crossley
2,288,166 A 6/1942 Kucher
2,313,131 A 3/1943 Elias
2,545,163 A 3/1951 Naster
2,687,867 A 8/1954 Wolar
2,852,663 A 9/1958 Stuffer et al.
2,960,361 A 11/1960 Boutelle
2,971,737 A 2/1961 Parker
2,973,895 A 3/1961 Brown et al.
3,078,366 A 2/1963 Winkler
3,082,987 A 3/1963 Robinson
3,154,704 A 10/1964 Shaffer
3,299,200 A 1/1967 Sulzer
3,299,265 A 1/1967 Rackley et al.
3,319,203 A 5/1967 Haughney
3,388,246 A 6/1968 Bailey
3,433,449 A 3/1969 Musante
3,479,081 A 11/1969 Schaaf
3,505,515 A 4/1970 Adra
3,541,478 A 11/1970 Peterson et al.
3,604,916 A 9/1971 Adra et al.
3,747,883 A 7/1973 Inman
3,754,724 A 8/1973 Osowski
3,778,610 A 12/1973 Wolf (Continued)

*Primary Examiner*—Thomas M Sember
(74) *Attorney, Agent, or Firm*—Middleton Reutlinger; John F. Salazar

(57) ABSTRACT

A rear trim ring for a vandal resistant luminaire having a round front and rear opening, the rear opening mounts flush to the surface onto which the luminaire is installed eliminating pry points between the luminaire and mounting surface, and an annular space between the rear trim ring and a luminaire housing provides room for the rear trim ring to deform upon the application of physical shock absorbing a portion of the shock applied thereto.

16 Claims, 7 Drawing Sheets

U.S. PATENT DOCUMENTS 3,840,735 A 10/1974 Chan
3,852,588 A 12/1974 Grawford
3,991,905 A 11/1976 Nicpon
4,000,406 A 12/1976 Bhavsar
4,090,210 A 5/1978 Wehling et al.
4,112,483 A 9/1978 Small, Jr. et al.
4,141,061 A 2/1979 Ford et al.
4,143,413 A 3/1979 Kelly
4,173,037 A 10/1979 Henderson, Jr. et al.
4,212,050 A 7/1980 Trenkler
4,254,456 A 3/1981 Grindle et al.
4,310,876 A 1/1982 Small, Jr. et al.
4,319,313 A 3/1982 Eberhart et al.
4,323,954 A * 4/1982 Florence et al. ..... 362/267
4,333,131 A 6/1982 Hujimoto et al.
4,337,507 A 6/1982 Lasker
4,403,278 A 9/1983 Flood
4,414,616 A 11/1983 de Vos et al.
4,422,135 A 12/1983 McCamy
4,449,168 A 5/1984 Ewing
4,459,648 A 7/1984 Ullman
4,460,948 A 7/1984 Malola
4,473,873 A 9/1984 Quiogue
4,527,224 A 7/1985 Sangiamo et al.
4,590,544 A 5/1986 Decandia
4,623,956 A 11/1986 Conti
4,709,890 A 12/1987 Moore
4,760,511 A 7/1988 Russello et al.
4,794,501 A 12/1988 Bartenbach
4,893,224 A 1/1990 Tinley
4,970,634 A 11/1990 Howell et al.
5,016,150 A 5/1991 Gordin et al.
5,047,907 A 9/1991 Hawkins
5,068,769 A 11/1991 Umeda et al.
5,111,371 A 5/1992 Nielson
5,249,110 A 9/1993 Russello et al.
5,307,254 A 4/1994 Russello et al.
5,323,995 A 6/1994 Grittman et al.
5,339,234 A 8/1994 Russello et al.
5,416,683 A 5/1995 McCarthy
5,442,132 A 8/1995 Sandell et al.
5,613,766 A 3/1997 Raouf
5,642,934 A 7/1997 Haddad
5,647,659 A 7/1997 Mori
5,671,997 A 9/1997 Potts
5,690,419 A 11/1997 Siems
5,704,710 A 1/1998 Greene et al.
5,722,770 A 3/1998 Douglas
5,803,585 A 9/1998 Littman et al.
5,845,988 A 12/1998 Mandall
5,906,431 A 5/1999 Chianale et al.
6,042,251 A 3/2000 McCarthy et al.
6,059,424 A 5/2000 Kotloff
6,116,564 A 9/2000 Cates
6,250,781 B1 6/2001 Straus et al.
6,290,376 B1 9/2001 Gutierrez et al.
6,293,510 B1 9/2001 Bradford et al.
6,375,141 B1 4/2002 Kettlestrings
6,517,216 B1 2/2003 Cercone et al.
6,530,681 B2 3/2003 Sieczkowski
6,607,292 B2 8/2003 Gutierrez et al.
6,733,158 B2 5/2004 Fisher et al.
6,848,806 B2 2/2005 Yoshida et al.
6,905,222 B1 6/2005 Russello et al.
7,090,382 B2 8/2006 Haddad et al.
7,121,684 B2 10/2006 Barozzini et al.
7,150,542 B1 12/2006 Russello et al.
2005/0117333 A1 6/2005 Yoshida et al.

* cited by examiner

REAR TRIM RING FOR A VANDAL RESISTANT LUMINAIRE

CROSS-REFERENCE TO RELATED APPLICATIONS

This application under 35 USC § 119(e) claims priority to, and benefit from, U.S. Provisional Application Ser. No. 60/745,913, filed on Apr. 28, 2006, entitled "Rear Trim Ring for a Vandal Resistant Luminaire," which is currently pending naming the above-listed persons as joint inventors.

STATEMENT REGARDING FEDERALLY SPONSORED RESEARCH OR DEVELOPMENT

Not applicable.

FIELD OF INVENTION

The present invention relates to luminaires or more specifically an aesthetic and physical shock absorbing rear trim ring for a vandal-resistant luminaire.

BACKGROUND OF THE INVENTION

Many existing public locations, both indoor and outdoor, have luminaires installed. Even though these luminaires are intended to benefit the public they are often times an annoyance for a would be vandal or thief. Therefore, luminaires have long have been targeted for disablement or destruction by vandals, thieves, and others seeking to reduce the amount of light present in a given locale. Luminaire electrical component housings and lamps contained within the electrical component housings of such luminaires are typically fragile in construction. Physical impact or even mere jarring can disable a luminaire or even destroy a portion thereof. The damage can occur to the electrical component housing, lamp, lens, or other component thereby extinguishing the light emitted by the luminaire. Attempts have been made to address this problem for those seeking to maintain the functional status of a luminaire in a public place. This has been addressed by constructing armored luminaires which have an armored electrical component housing or by placing the luminaire out of reach to the public. However, the armor has tended to make the luminaire less aesthetic than desired and the locating of the luminaires out of reach often times decreases the ability of the luminaire to light a desired area. More recently, plastics have been used in the construction of vandal resistant luminaires. However, they have lacked the configuration necessary to provide the level of resistance to tampering and aesthetics as desired.

Thus a need continues to exist for luminaires to resist the attempts of vandals, would-be thieves, and the like from destroying the luminaire or extinguishing the light emitted thereby while providing adequate light and a more aesthetic vandal resistant luminaire.

SUMMARY OF THE INVENTION

The present invention relates to a rear trim ring for use in a vandal resistant luminaire intended for use in a public area and designed to resist physical damage from impact while providing adequate light and an aesthetic luminaire. The luminaire trim ring is designed to absorb physical shock placed on the luminaire, protect an electrical component housing from side impact, eliminate perimeter pry or holding points between the luminaire and a mounting surface, and provide for an aesthetically pleasing vandal resistant luminaire.

Preferably the rear trim ring is comprised of a polycarbonate material and more preferably an ultraviolet stabilized polycarbonate material. The preferred method of manufacture is injection molding. The rear trim ring preferably has a substantially cylindrical configured side wall, optionally frustoconical, tapered, or curved, with housing contact projections, mating extensions, and indentations with adhesive strips proximate a top opening for mating to an outwardly extending rim on an electrical component housing creating an aesthetic seamless outer surface while eliminating pry points between the electrical component housing and surface to which it is mounted. The internal surface optionally has reinforcing ribs. The side wall is optionally tapered with a larger opening adjacent the surface to which it is mounted while the electrical component housing optionally has a tapered side wall with a smaller diameter proximate the surface to which it is mounted. Such configurations create an annular space between the rear trim ring and electrical housing where contact between the two components is proximate the front opening of the rear trim ring and the housing contact projections. This annular space provides room for deformation of the rear trim ring thus enabling the rear trim ring to absorb physical shock prior to impact of the luminaire housing. Optionally this annular space is filled with foam, preferably high density, neoprene rubber, or other shock absorbing material increasing the shock absorbing capacity of the rear trim ring and luminaire.

DETAILED DESCRIPTION

The present invention relates to a rear trim ring for use in a vandal resistant luminaire intended for use in a public area and designed to resist physical damage from impact while providing adequate light and an aesthetic luminaire. The luminaire rear trim ring depicted in the various figures is selected solely for the purpose of illustrating the invention. Other and different rear trim rings may utilize the inventive features described herein. Reference to the Figures showing embodiments are made only for descriptive purposes and are not intended to limit the scope of the claims and disclosure herein.

Figure 1:
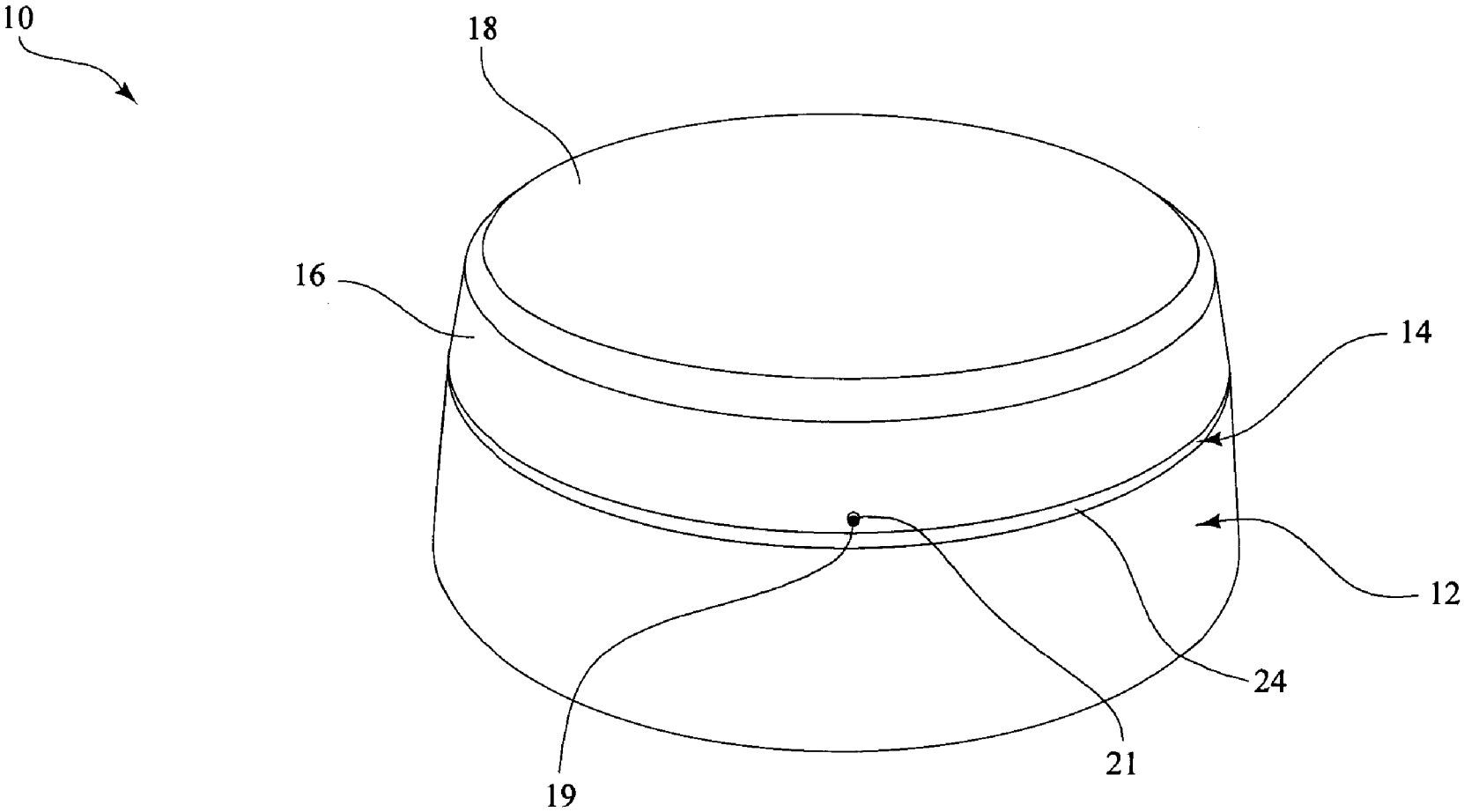
FIG. 1 is a perspective view of a vandal resistant luminaire showing external components thereof and positioning of the rear trim ring within the luminaire.

FIG. 1 shows the external components of vandal resistant luminaire 10. Rear trim ring 12 covers a portion of electrical component housing 14 providing an aesthetically pleasing rear side of luminaire 10 while increasing security of luminaire 10 by providing a smooth outer side surface mounting flush against a wall or ceiling reducing hold and pry points. Electrical component housing 14 has an outwardly extending rim 24 visible in fully assembled luminaire 10 between rear trim ring 12 and front trim ring 16. Front trim ring 16 surrounds an outer portion of lens 18 and electrical component housing 14 and locks onto electrical component housing 14 and is held in a locked position with locking fastener 19 extending through locking fastener receptacle 21 in front trim ring 16. Rear trim ring 12 surrounds a rear portion of electrical component housing 14 providing a smooth outer surface for vandal resistant luminaire 10. Rear trim ring 12 preferably has a polycarbonate material, an ultraviolet stabilized material, or both and is preferably formed by an injection mold process. Rear trim ring 12 has a substantially flat rear edge for mounting flush against a wall or ceiling eliminating pry points between luminaire 10 and the surface to which it is mounted and holding points about luminaire 10.

Figure 2:
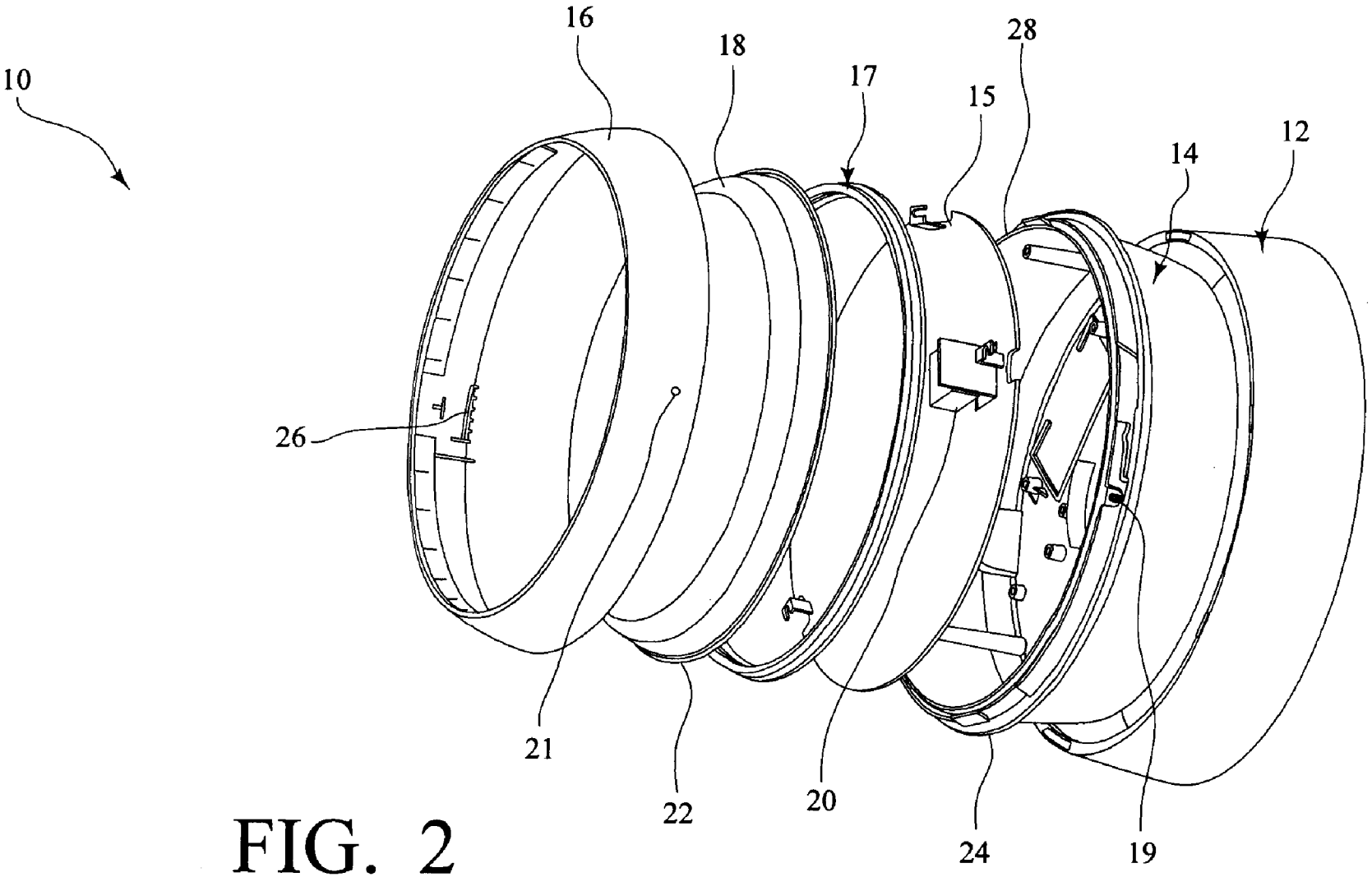
FIG. 2 is an exploded view of the vandal resistant luminaire of FIG. 1 showing the internal components and the cooperation of the rear trim ring with the luminaire components.

FIG. 2 shows the internal components of vandal resistant luminaire 10 and the placement of rear trim ring 12 therein. Rear trim ring 12 is removed from electrical component housing 14 showing the outer configuration of electrical component housing 14 and cooperation between rear trim ring 12, outer rim 24 of electrical component housing 14, and front trim ring 16. Lamp holder assembly 15 attaches within electrical component housing 14 and has lamp socket 20 on a front surface. The front surface of lamp holder 15 is preferably comprised of a reflective material. Front trim ring 16 holds lens 18 to electrical component housing 14 with gasket 17 there between providing a smooth outer front surface for vandal resistant luminaire 10. Gasket 17 is placed about gasket ring 28, both of which are optional and shown having a continuously round configuration, on electrical component housing 14. Front trim ring 16 has twist locks 26 with sloping surfaces for securing about electrical component housing 14 and locks thereto with locking fastener 19 extending into locking fastener receptacle 21 in front trim ring 16. Lens 18 has outer lip 22 that cooperates with front trim ring 16 on a front surface and gasket 17 on a rear surface.

Figure 3A:
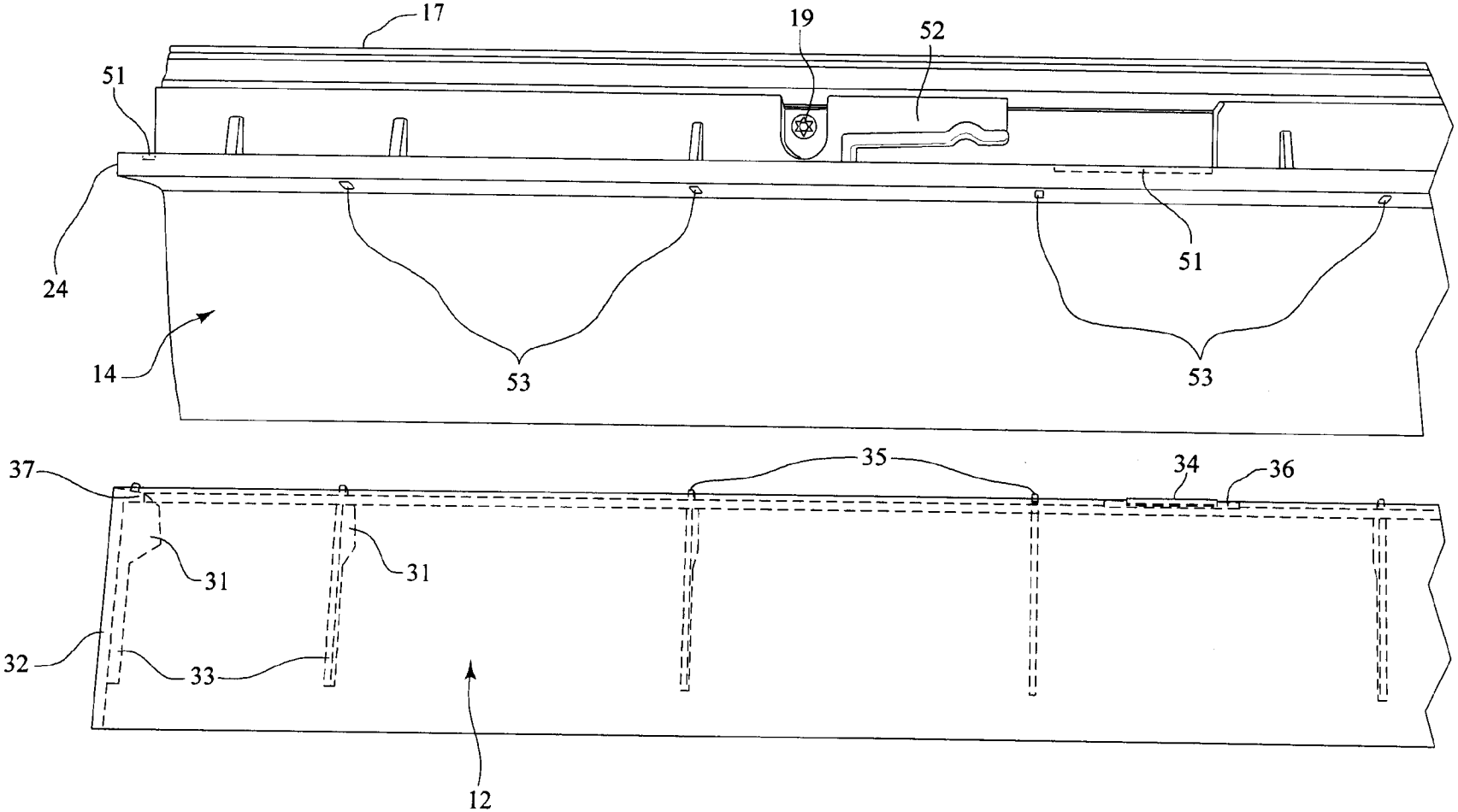
FIG. 3A is cutaway view of the trim ring of FIG. 1 showing it removed from a portion of the housing for receiving same.
Figure 3B:
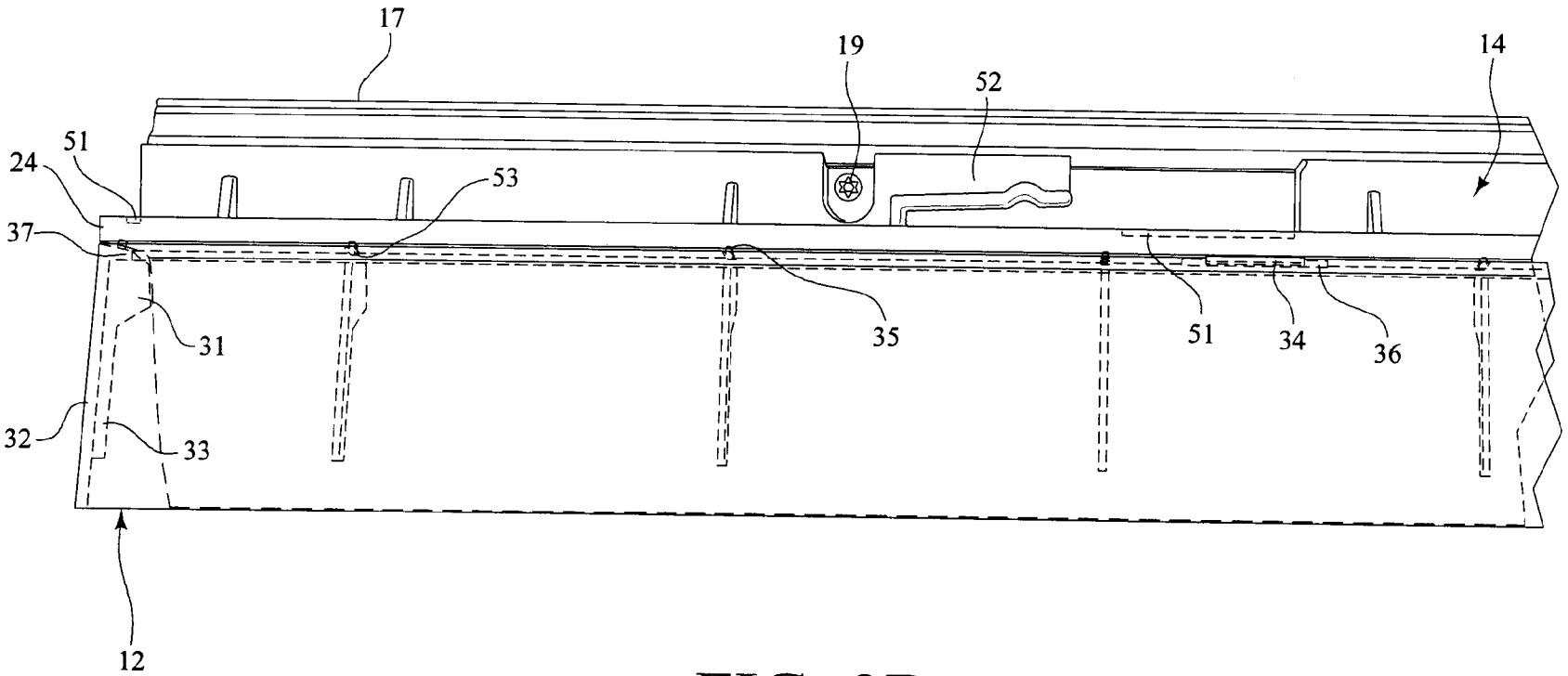
FIG. 3B is cutaway view of the trim ring of FIG. 1 showing it engaged with a portion of the housing.

FIGS. 3A and 3B show the cooperation between rear trim ring 12 having a shock absorbing configuration and electrical component housing 14. FIG. 3A shows rear trim ring 12 spaced apart from electrical component housing 14 while FIG. 3B shows it engaged thereon surrounding an outer rear portion of electrical component housing 14. Electrical component housing 14 has several features for engaging a lens and front trim ring which are in front of outwardly extending rim 24 and include gasket 17, retaining legs 52, retaining fastener 19 and guide slots 51. These components are optional and do not serve to limit the present disclosure. Electrical component housing 14 has optional rear ring mating indentations 53 on a rear side of outwardly extending rim 24. Outwardly extending rim 24 has an outer edge that has a radius substantially equal to a radius of the outer front edge of rear trim ring 12 thus exposing and forming a substantially outer surface with outwardly extending rim 24, as shown in FIG. 3B. Optionally, rim 24 is customized and/or colored and exposed between rear trim ring 12 and front trim ring 16. Side wall 32 is shown as having a substantially round cross-sectional area and is shown here as having a frustoconical configuration with the rear opening having a larger radius than the front opening. Side wall 32 may be curved, substantially cylindrical, or other configuration for covering a rear portion of electrical component housing 14 providing a rear mating surface upon installation without pry points and the elimination of holding points about a rear portion of luminaire 10. Optional reinforcing ribs 33, optional electrical component housing projections 31, and optional housing mating extensions 35 are shown here as an axially aligned unitary structure extending inward from side wall 32. These optional components need not be unitary but may be staggered about side wall 32. Proximate the front opening of rear trim ring 12 is an optional inwardly extending flange 37 having a configuration for mating a rear surface of outwardly extending rim 24. Extending from a front surface of flange 37 are housing mating extensions 35 which seat in rear ring mating indentations 53 as shown in FIG. 3B. Optionally, extending flange 37 has a series of indentations 36 in a front surface thereof for holding an adhesive strip 34 for adhesively adhering rear trim ring 12 to electrical component housing 14. However, upon installation, vandal resistant luminaire 10 having rear trim ring 12 is held flush against a mounting surface with outwardly extending rim 24, hence even though adhesive strips 34 aid in the installation of vandal resistant luminaire 10 they are not required and thus optional. As shown in FIG. 3B, the rear of electrical component housing 14 has a rear wall substantially flush with the substantially flat opening in rear trim ring 12 forming a substantially flush mating surface. Therefore, mounting a vandal resistant luminaire with rear trim ring 12 provides a luminaire without pry points between the luminaire and surface to which it is mounted and without holding points about a rear portion of the luminaire. Also shown in FIG. 3*b* is an annular space between side wall 32 and electrical component housing 14. This annular space may be left open, filled with a foam material (preferably high density foam) or other shock absorbing material such as a rubber or neoprene material adding to the shock absorbing capacity of rear trim ring 12.

Figure 4:
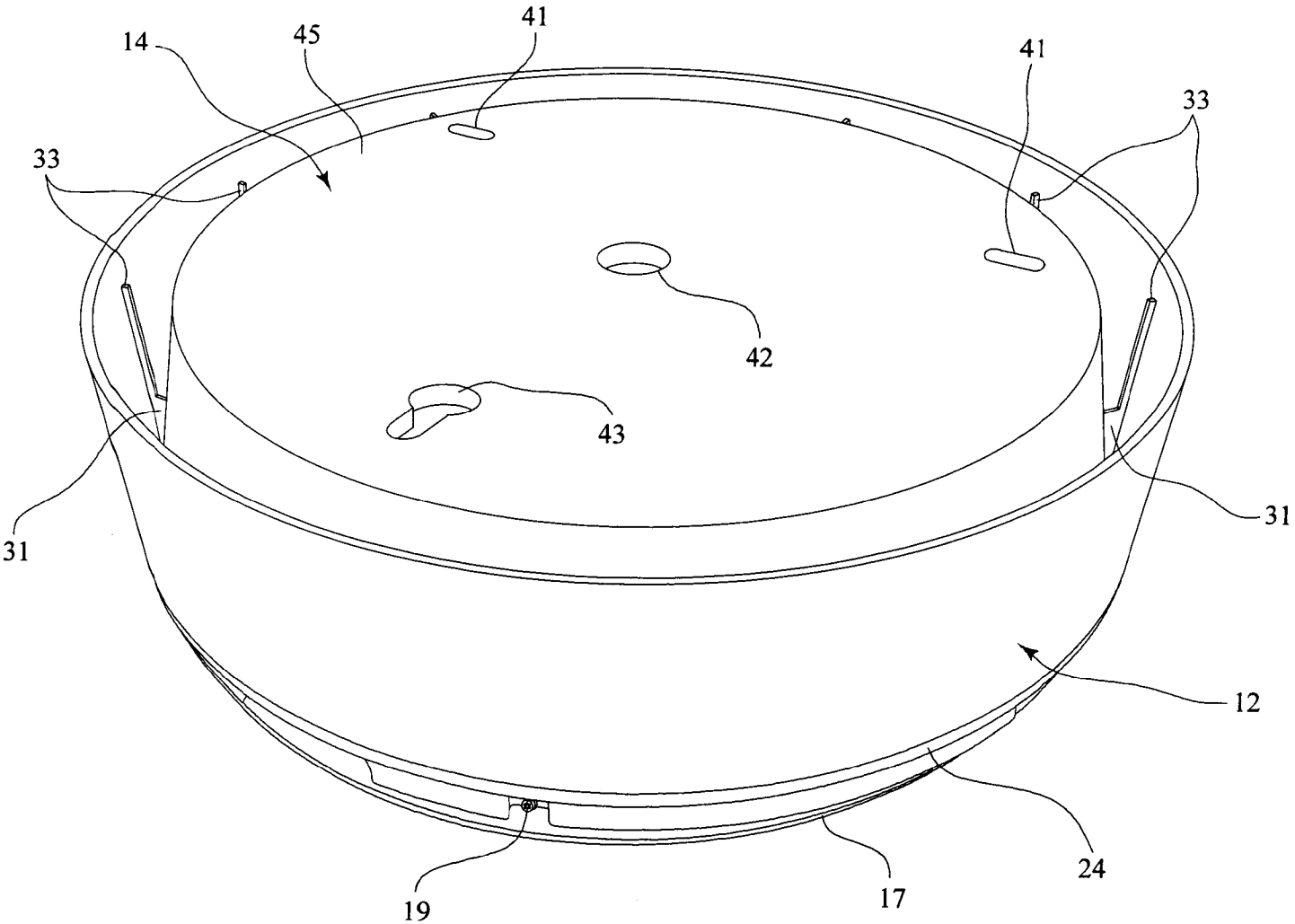
FIG. 4 is a perspective rear view of the trim ring of FIG. 1 mounted to an electrical component housing.

FIG. 4 shows rear wall 45 of electrical component housing 14 with rear trim ring 12 mounted thereto. Rear wall 45 has a substantially disk shaped configuration and has mounting slots 41 and fastener aperture 43 for mounting flush on a substantially flat surface. Electrical aperture 42 provides for the electrical hookup of at least one lamp socket contained within electrical component housing 14. Rear trim ring 12 has optional reinforcing ribs 33 extending from optional electrical component housing projections 31 which contact electrical component housing 14 proximate a front surface when installed thereon as shown. Outwardly extending flange 24 has a front edge of rear trim ring 12 adjacent thereto. Also shown here are several features for engaging a lens and front trim ring which include gasket 17 and retaining fastener 19.

Figure 5:
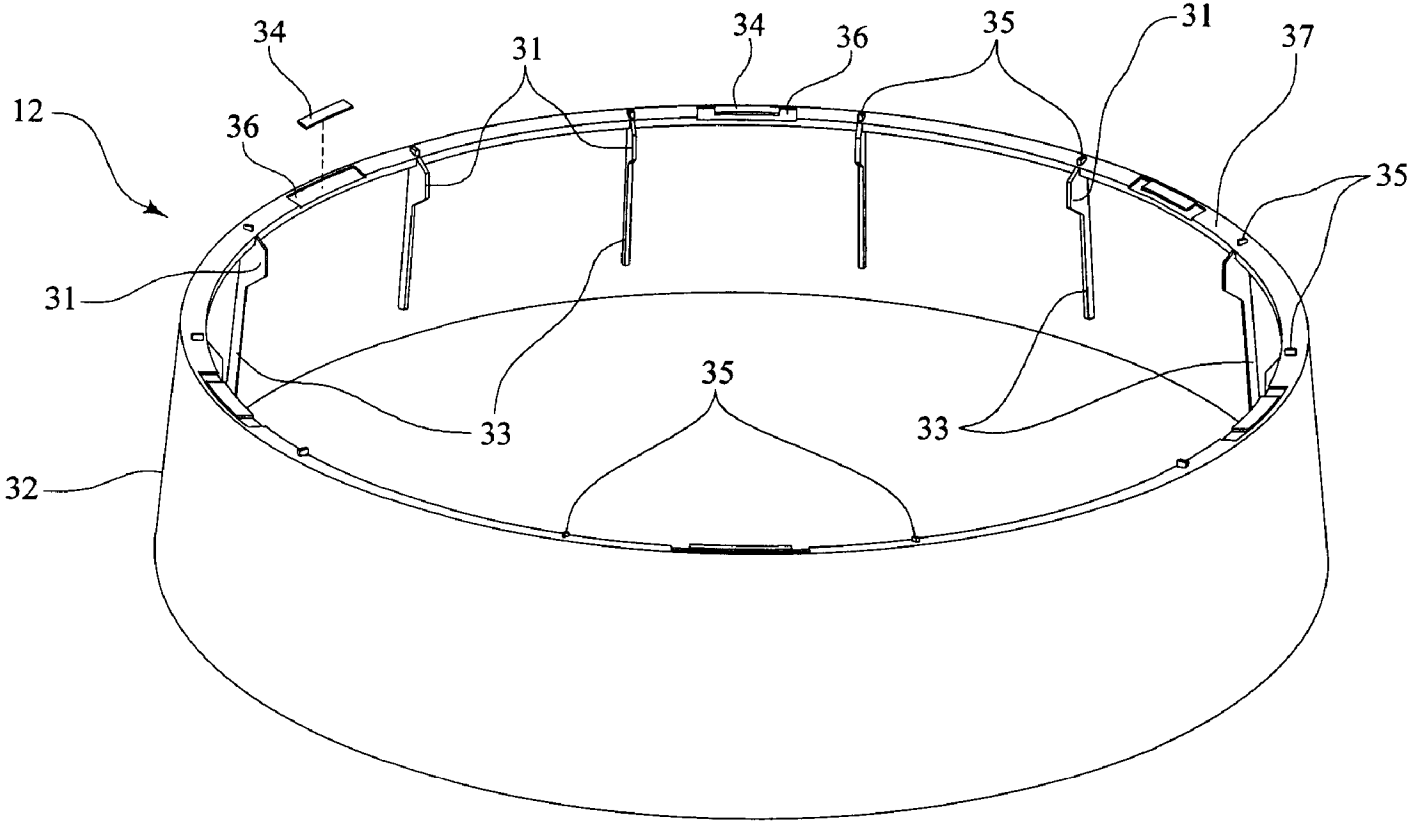
FIG. 5 is a top perspective view of the trim ring of FIG. 1.

FIG. 5 shows a top view of rear trim ring 12 having optional adhesive strip 34 removed there from. Side wall 32 is shown here as having a frustoconical configuration with the front opening having a larger radius than the rear opening. Side wall 32 may be axially curved, substantially cylindrical, frustoconical, or other configuration. Optional reinforcing ribs 33, electrical component housing projections 31, and housing mating extensions 35 extending inward from side wall 32 are unitary structures as shown or may be individual components spaced about the inner circumferential surface of side wall 32. Proximate the front opening of rear trim ring 12 is an inwardly extending flange 37 which is shown in this embodiment as sloping downward. Extending from a front surface of flange 37 are housing mating extensions 35. Extending flange 37 has a series of indentations 36 in a front surface thereof for holding adhesive strips 34. Extending flange 37, indentations 36, and adhesive strips 34 are all optional components since rear trim ring 12 can provide a shock absorbing structure mounted between an outwardly extending rim on electrical component housing and a mounting surface without any or all of these features.

Figure 6:
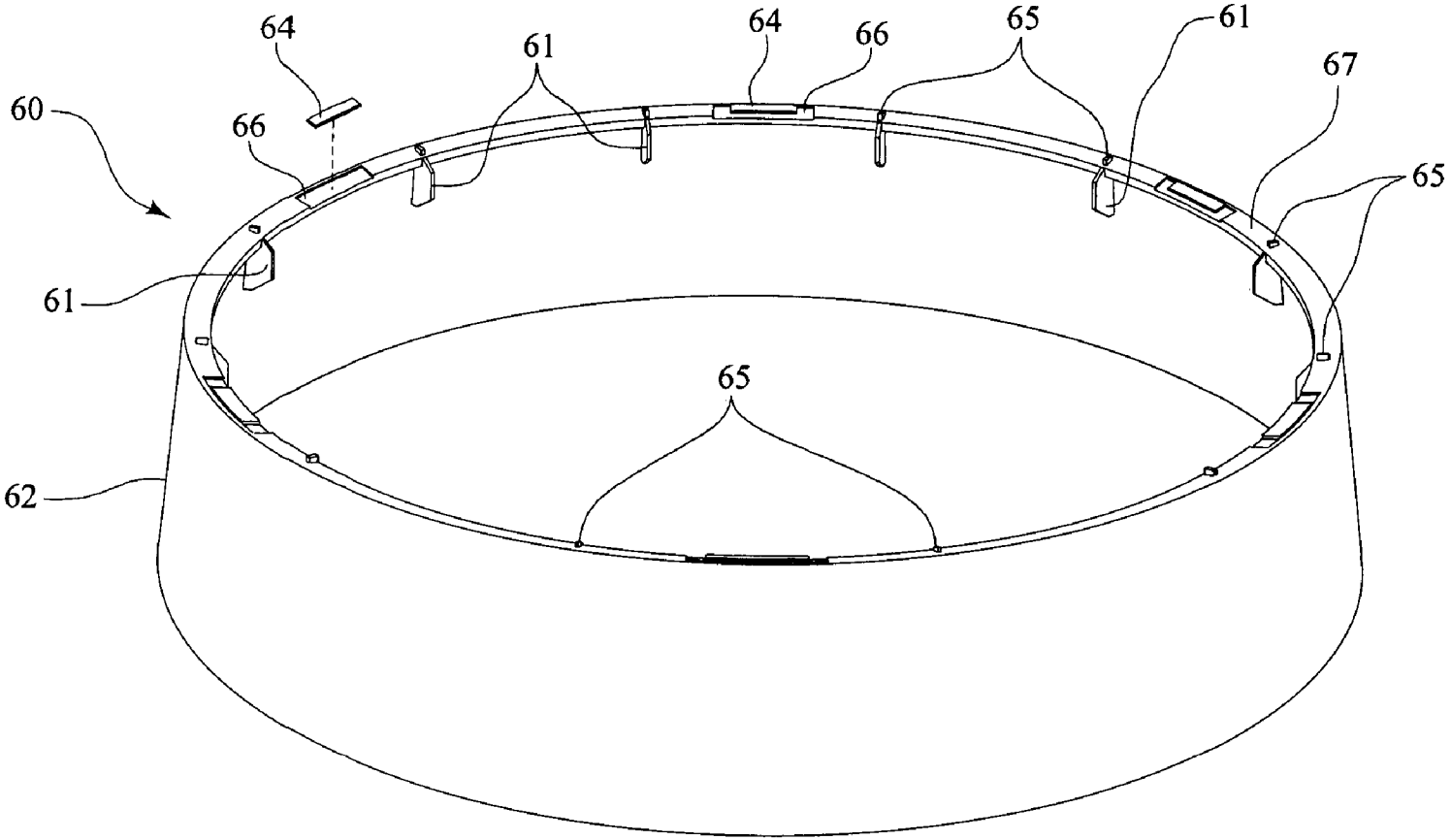
FIG. 6 is a perspective view of an alternative embodiment of a rear trim ring.

FIG. 6 shows an alternative embodiment of a rear trim ring indicated as rear trim ring 60. Side wall 62 is shown here as having a frustoconical configuration with the rear opening having a larger radius than the front opening. Side wall 62 may be curved, substantially cylindrical, or other configuration. Electrical component housing projections 61 and housing mating extensions 65 are shown here as a unitary structures axially extending and extending inward from side wall 62. Electrical component housing projections 61 and housing mating extensions 65 are optional features in this and any embodiment since rear trim ring 60 can provide a shock absorbing structure mounted between an outwardly extending rim on an electrical component housing and a mounting surface without any or all of these features. Additionally, electrical component housing projections 61 and housing mating extensions 65 need not bee unitary but may be offset about flange 67. Extending flange 67 has a series of indentations 66 in a front surface thereof for holding adhesive strips 64, one of which is shown removed there from.

A rear trim ring for a vandal resistant luminaire is provided herein for improving the resilience and aesthetics of the luminaire. The rear trim ring circumscribes a rear portion of a housing forming a flush mount of the luminaire substantially eliminating pry points between the luminaire and surface to which it is mounted and substantially eliminating hold points about a rear portion of the luminaire. An annular space between the rear trim ring and housing allows for deformation of the rear trim ring upon the application of a physical shock thereto thus absorbing a portion of the force protecting the luminaire. Optionally, internal features such as ribs and electrical component housing projections may be incorporated within the rear trim ring.

Additionally, the annular space between the rear trim ring and electrical component housing may be filled with a shock absorbing material such as foam or rubber (i.e. neoprene).

We claim:

1. A vandal resistant luminaire having a rear trim ring, said rear trim ring surrounding an outer rear portion of an electrical component housing of said luminaire, said rear trim ring being constructed to absorb physical shock to protect said vandal resistant luminaire from said physical shock, said rear trim ring having a substantially circular side wall spaced from said housing, a substantially flat rear mating edge, and a front surface about a front opening suitable for mounting substantially flush with an outwardly extending rim on said electrical component housing, thereby substantially eliminating pry points between said electrical component housing and a surface to which it is mounted, and substantially eliminating hold points about a rear portion of said luminaire;

wherein said side wall has a rear opening with a larger radius than said front opening forming an annular space between an inner surface of said rear trim ring and said electrical component housing;

said annular space is filled with a shock absorbing material.

2. The vandal resistant luminaire of claim 1 wherein said annular space is filled with a foam material.

3. The vandal resistant luminaire of claim 1 wherein said annular space is filled with neoprene.

4. The vandal resistant luminaire of claim 1 wherein said side wall of said rear trim ring has shock absorbing ribs axially extending from the inner surface thereof.

5. The vandal resistant luminaire of claim 1 wherein said side wall has electrical component housing contact projections axially extending from the inner surface thereof proximate said front opening.

6. The vandal resistant luminaire of claim 1 wherein said side wall has an inwardly extending flange adjacent said front opening.

7. The vandal resistant luminaire of claim 6 wherein said inwardly extending flange has indentations on a top surface thereof substantially equidistantly spaced about said flange.

8. The vandal resistant luminaire of claim 1 wherein said side wall has housing mating extensions extending from said side wall adjacent said front opening.

9. A vandal resistant luminaire, comprising:

a rear trim ring, said rear trim ring surrounding an outer rear portion of an electrical component housing of said luminaire, said rear trim ring being constructed to absorb physical shock to protect said vandal resistant luminaire from said physical shock, said rear trim ring having a substantially circular side wall spaced from said housing, a substantially flat rear mating edge, and a front surface about a front opening suitable for mounting substantially flush with an outwardly extending rim on said electrical component housing, thereby substantially eliminating pry points between said electrical component housing and a surface to which it is mounted, and substantially eliminating hold points about a rear portion of said luminaire wherein said side wall has an inwardly extending flange adjacent said front opening wherein said inwardly extending flange has indentations on a top surface thereof substantially equidistantly spaced about said flange wherein each of said indentations have an adhesive strip applied therein, said adhesive strips having front and rear adhesive surfaces.

10. A vandal resistant luminaire comprising:

an electrical component housing having at least one lamp socket and associated wiring contained therein, said electrical component housing having a substantially circular side wall with an outwardly extending rim delineating a front and rear portion of said electrical component housing and a substantially disk shaped rear wall; and a rear trim ring surrounding said rear portion of said electrical component housing, said rear trim ring having a rear opening substantially within a plane of said disk shaped rear wall of said electrical component housing, said rear trim ring having a front opening substantially adjacent said outwardly extending rim, said rear trim ring having a side wall of a larger radius than said side wall of said electrical component housing forming a void between a substantial portion of said rear portion of said electrical component housing and said rear trim ring, said rear trim ring being of a material which will deform when a physical shock is exerted thereon thereby absorbing a portion of said physical shock wherein said void is filled with a shock absorbing material.

11. The vandal resistant luminaire of claim 10 wherein said void shock absorbing material is a high density foam material.

12. The vandal resistant luminaire of claim 10 wherein said void shock absorbing material is a neoprene.

13. The vandal resistant luminaire of claim 10 wherein said side wall of said rear trim ring has axially aligned shock absorbing ribs extending from an inner surface thereof.

14. A vandal resistant luminaire comprising:

an electrical component housing having at least one lamp socket and associated wiring contained therein, said electrical component housing having a substantially circular side wall with an outwardly extending rim delineating a front and rear portion of said electrical component housing and a substantially disk shaped rear wall; and a rear trim ring surrounding said rear portion of said electrical component housing, said rear trim ring having a rear opening substantially within the plane of said disk shaped rear wall of said electrical component housing, said rear trim ring having a front opening substantially adjacent said outwardly extending rim, said rear trim ring having a side wall of a larger radius than said side wall of said electrical component housing forming a void between a substantial portion of said rear portion of said electrical component housing and said rear trim ring, said rear trim ring being of a material which will deform when a physical shock is exerted thereon thereby absorbing a portion of said physical shock;

wherein said side wall of said rear trim ring has a series of electrical component housing mating projections substantially equidistantly spaced about the circumference of and axially extending inwardly from said side wall proximate said front opening.

15. A vandal resistant luminaire comprising:

an electrical component housing having at least one lamp socket and associated wiring contained therein, said electrical component housing having a substantially circular side wall with an outwardly extending rim delineating a front and rear portion of said electrical component housing and a substantially disk shaped rear wall; and a rear trim ring surrounding said rear portion of said electrical component housing, said rear trim ring having a rear opening substantially within the plane of said disk shaped rear wall of said electrical component housing, said rear trim ring having a front opening substantially adjacent said outwardly extending rim, said rear trim ring having a side wall of a larger radius than said side wall of said electrical component housing forming a void between a substantial portion of said rear portion of said electrical component housing and said rear trim ring, said rear trim ring being of a material which will deform when a physical shock is exerted thereon thereby absorbing a portion of said physical shock;

wherein said side wall of said rear trim ring has a series of housing mating extensions axially extending from and substantially equidistantly spaced about an inwardly extending flange surrounding said front opening.

16. A vandal resistant luminaire comprising:

an electrical component housing having at least one lamp socket and associated wiring contained therein, said electrical component housing having a substantially circular side wall with an outwardly extending rim delineating a front and rear portion of said electrical component housing and a substantially disk shaped rear wall; and a rear trim ring surrounding said rear portion of said electrical component housing, said rear trim ring having a rear opening substantially within the plane of said disk shaped rear wall of said electrical component housing, said rear trim ring having a front opening substantially adjacent said outwardly extending rim, said rear trim ring having a side wall of a larger radius than said side wall of said electrical component housing forming a void between a substantial portion of said rear portion of said electrical component housing and said rear trim ring, said rear trim ring being of a material which will deform when a physical shock is exerted thereon thereby absorbing a portion of said physical shock;

wherein said side wall of said rear trim ring has shock absorbing ribs extending from an inner surface thereof axially aligned and substantially equidistantly spaced about the inner circumference thereof, a series of electrical component housing mating projections extending inwardly from said shock absorbing ribs, and a series of housing mating extensions axially extending from an inwardly extending flange surrounding said front opening.

* * * * *